United States Patent [19]

Orr

[11] 4,201,427

[45] May 6, 1980

[54] SEWING MACHINE POSITIONER DEVICE

[75] Inventor: John L. Orr, Rockford, Ill.

[73] Assignee: Keystone Consolidated Industries, Inc., Rockford, Ill.

[21] Appl. No.: 931,486

[22] Filed: Aug. 7, 1978

[51] Int. Cl.[2] ..... A47B 81/00

[52] U.S. Cl. ..... 312/21; 312/27; 312/30; 108/37; 112/217.1

[58] Field of Search ..... 312/21, 26, 27, 28, 312/29, 30, 208; 108/37, 136; 112/217.1

[56] References Cited

U.S. PATENT DOCUMENTS

| | | | |
|---|---|---|---|
| Re. 28,835 | 6/1976 | Roberts et al. | 312/29 |
| 619,319 | 2/1899 | Kundtz et al. | 312/26 |
| 1,057,809 | 4/1913 | Diehl et al. | 312/21 |
| 1,318,677 | 10/1919 | Lemon | 312/27 |
| 2,247,380 | 7/1941 | Hohmann | 312/30 |
| 2,398,696 | 4/1946 | Colegrove | 312/28 |
| 2,605,156 | 7/1952 | Laxo | 108/136 |
| 2,839,938 | 6/1958 | Ahlgren et al. | 312/30 |
| 3,986,755 | 10/1976 | Kohara | 312/21 |
| 4,089,573 | 5/1978 | Aeschliman | 312/27 |

FOREIGN PATENT DOCUMENTS

| | | | |
|---|---|---|---|
| 501574 | 11/1954 | Italy | 312/30 |

*Primary Examiner*—Victor N. Sakran

*Attorney, Agent, or Firm*—Allegretti, Newitt, Witcoff & McAndrews

[57] ABSTRACT

A mechanism for positioning a sewing machine in a sewing machine cabinet includes an improved linkage attached to the cabinet and supporting a mounting platform for the sewing machine. The linkage permits movement of the platform between a storage position within the cabinet to either one of two horizontal operating positions. The linkage includes one pair of pivot arms connected from each side of the platform to a bracket suspended from the cabinet. Also one support pin projects from each side of the platform and cooperatively engages an associated positioner attached to the cabinet. The positioners retain the platform in either horizontal operating position. The platform may be tilted from the horizontal operating positions to release the support pins from the positioners and permit movement of the platform to another desired position.

33 Claims, 7 Drawing Figures

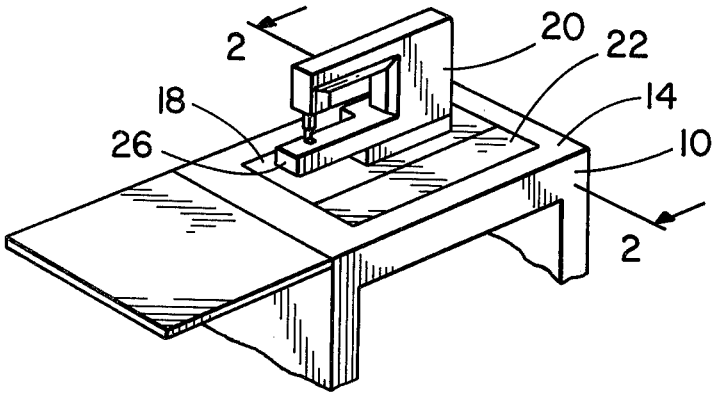
FIG.1
FIG.2
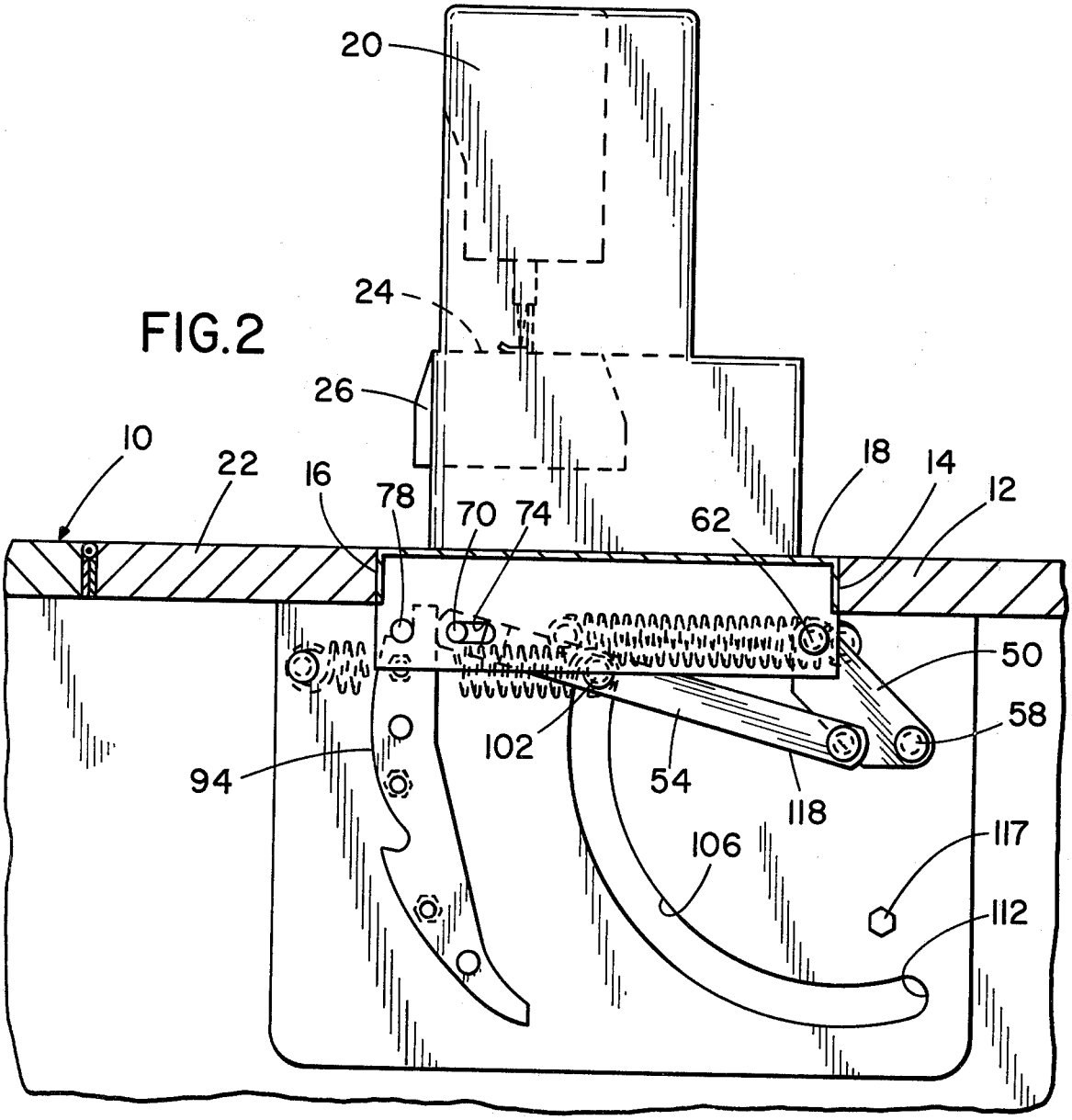

FIG.6
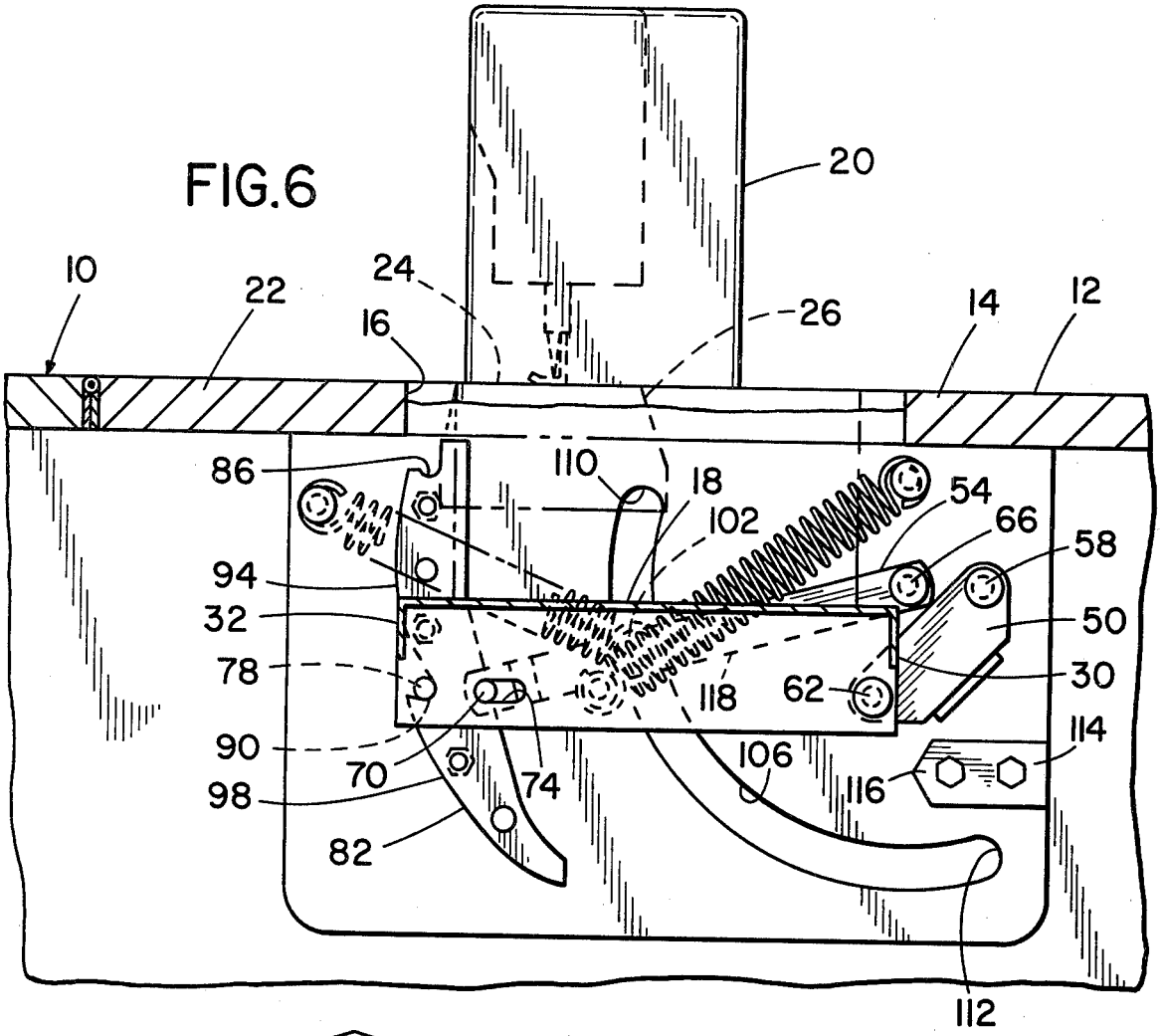
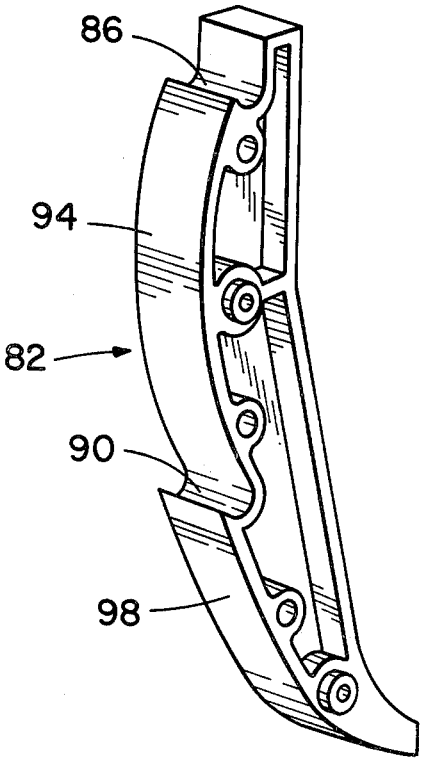
FIG.5

SEWING MACHINE POSITIONER DEVICE

BACKGROUND OF THE INVENTION

This invention relates to an improved mechanism for positioning a sewing machine within a cabinet and, more particularly, to an improved mechanism which connects a support platform for a sewing machine head to a sewing machine cabinet.

Sewing machines which are intended for home use are now often incorporated within a cabinet or similar piece of furniture. Preferably, the sewing machine unit itself, often termed the sewing machine head, is mounted on a platform. The platform is then positioned with respect to the top or working surface of the sewing machine cabinet and is preferably easily movable from a working position to a storage position within the cabinet. In this manner, when the sewing machine is not in use, the sewing machine head may be stored for protection and the cabinet may appear as a functional and attractive piece of furniture.

Various mechanisms have been proposed for attaching a sewing machine mounting platform to a cabinet. For example, patents which show various mechanisms for positioning sewing machine heads or other platforms with respect to a cabinet or table top include the following:

| Inventor | Title | U.S. Pat. No. |
|---|---|---|
| Roberts et al. | Work Cabinet for Sewing Machine | U.S. Reissue No. 28,835 |
| C. B. Lundstrom | Disappearing Support for Business Machines and the Like | U.S. Pat. No. 2,322,648 |
| J. Hickey | Sewing Machine | U.S. Pat. No. 2,337,193 |
| R. K. Hohmann et al | Convertible Sewing and Darning Machine | U.S. Pat. No. 2,409,758 |
| H. L. Hubbell | Cabinet and Elevating Apparatus | U.S. Pat. No. 2,790,689 |
| S. H. Carlson | Swinging Shelf Support | U.S. Pat. No. 2,822,229 |
| E. A. Cotton et al | Sewing Machine Cabinet | U.S. Pat. No. 2,887,350 |
| J. C. Hochman | Lid-Operated Actuator Mechanism for Controlling the Lift and Return of Drop-Head Machines and Machines Incorporating the Same | U.S. Pat. No. 2,977,170 |
| Moussaian et al | Locking Device for Sewing Machine Cabinet Support Platforms | U.S. Pat. No. 3,830,554 |
| D. Shepherd | Retracting Mechanism and Sewing Machine Cabinet | U.S. Pat. No. 3,870,386 |
| T. Kohara | Means for Mounting Sewing Machine in Cabinet | U.S. Pat. No. 3,986,755 |
| Smith et al | Vertically Adjustable Sewing Machine Mounting | U.S. Pat. No. 4,005,918 |
| Orr et al | Cam Adjustment For Tension Spring of Sewing Machine Head Lifter Mechanism | U.S. Pat. No. 4,018,487 |

French Pat. No. 722.915
Dutch Pat. No. 1,809,290

U.S. Pat. No. 4,108,512 in the name of Mr. Robert White relating to the structure of a sewing machine head positioner device recently issued. The White patent discloses a torsion bar mechanism to support and move a platform for the head to any one of a number of desired positions.

Present day sewing machines are useful in at least two operating positions. One of these positions is illustrated in FIG. 2 and is known as the "free arm position". Another position, illustrated in FIG. 6, is known as the "flat bed position". These are described in greater detail in the Description of the Preferred Embodiment and in Kohara, U.S. Pat. No. 3,986,755.

The above-described or referred mechanisms are useful and work well. Nonetheless, an improved mechanism which is adjustable to a number of working positions and a storage position is desired. In addition, any such mechanism preferably includes a counterbalance system to offset the weight of the sewing machine head as it is being lowered for storage within the cabinet. Such a mechanism should also include an arrangement to maintain the head and platform fixed in position against accidental movement from one of its working positions. These requirements, among others, inspired the development of the present invention.

SUMMARY OF THE INVENTION

In a principal aspect, the present invention comprises a mechanism for positioning a platform with respect to a working surface of a cabinet. More particularly, this invention relates to a mechanism for positioning a sewing machine head mounting platform with respect to an opening in the work surface of a sewing machine cabinet.

The mechanism disclosed provides for movement of the sewing machine head to a storage position, a flat bed position, or a free arm position. The mechanism includes pivot arms connecting the platform to brackets attached to the cabinet. A support member on the platform also engages a positioner attached to the cabinet to retain the platform at the desired operating position. Biasing means insure that the platform will be maintained in engagement with the positioner.

The platform may be manually tilted from an operating position to release the support member from the positioner and permit movement of the platform to another desired position. A cam track and follower mechanism incorporated with the platform and cabinet bracket may be included to define the path of the pivot arms and the limits of movement of the pivot arms and platform.

Thus it is an object of the present invention to provide an improved mechanism for positioning a sewing machine head within a cabinet.

Still a further object of the present invention is to provide an improved mechanism for positioning a sewing machine head at discrete operating positions, including a free arm position and a flat bed position as well as a storage position.

Another object of the present invention is to provide a sewing machine head support mechanism which incorporates an improved linkage connecting a support platform with a sewing machine cabinet in combination with an improved mechanism for positioning the platform with respect to the cabinet.

Still a further object of the present invention is to provide a mechanism for mounting a sewing machine head in a sewing machine cabinet having a minimum number of separate parts, which is economical to manufacture, easy to install and may be used for mounting numerous types of sewing machine heads.

These and other objects, advantages and features of the invention will be set forth in greater detail in the description which follows.

BRIEF DESCRIPTION OF THE DRAWING

In the detailed description which follows reference will be made to the drawing comprised of the following figures:

FIG. 1 is a perspective view of a typical sewing machine head mounted on a cabinet;

FIG. 2 is a cross sectional view of the cabinet shown in FIG. 1 taken along the line 2—2 illustrating the position of the sewing machine head in the free arm position;

FIG. 5 is perspective view of the positioner mechanism associated with the front edge of the platform;

FIG. 6 is a cross sectional side view similar to FIG. 2 wherein the platform has been moved to the flat bed position.

DESCRIPTION OF THE PREFERRED EMBODIMENT

Figure 3:
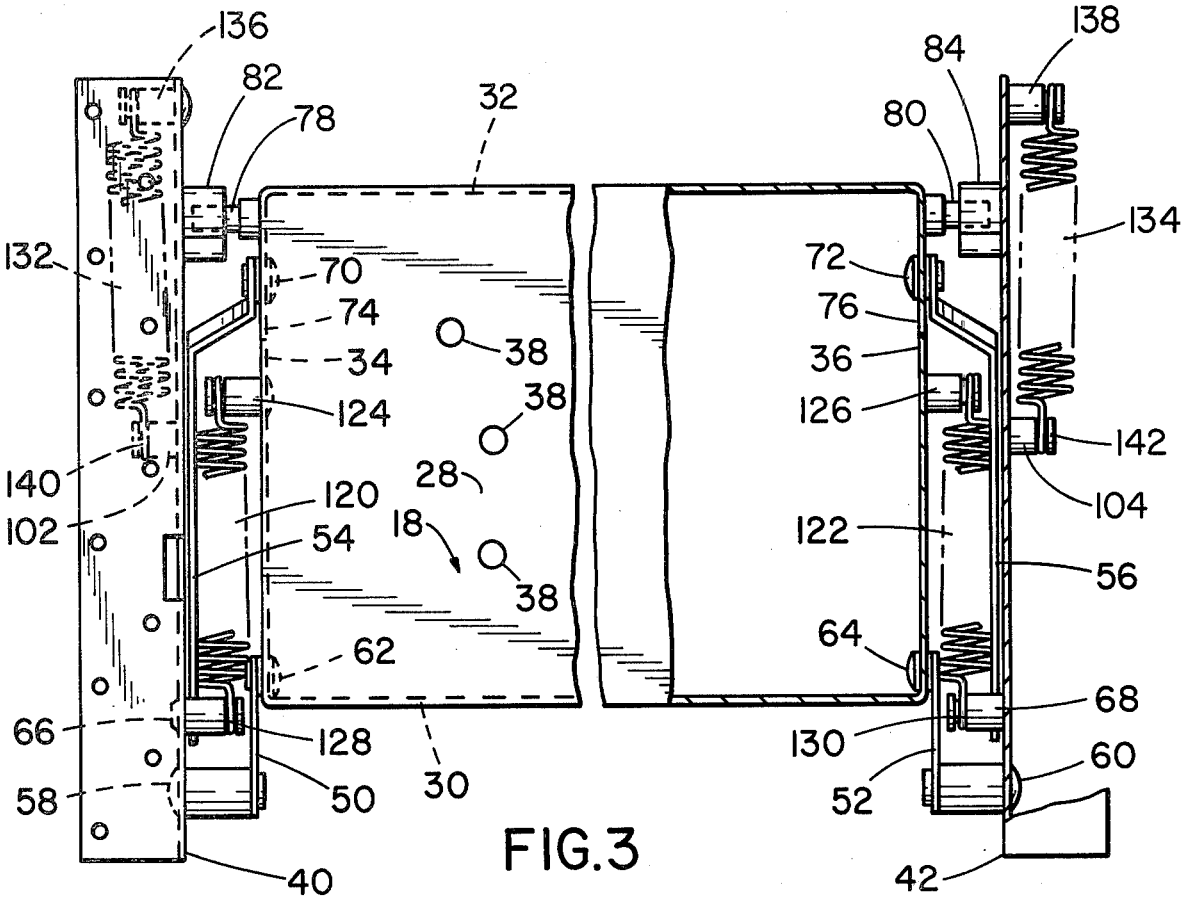
FIG. 3 is a top plan view of the platform linkage mechanism for supporting the platform on which the sewing machine head is positioned.
Figure 4:
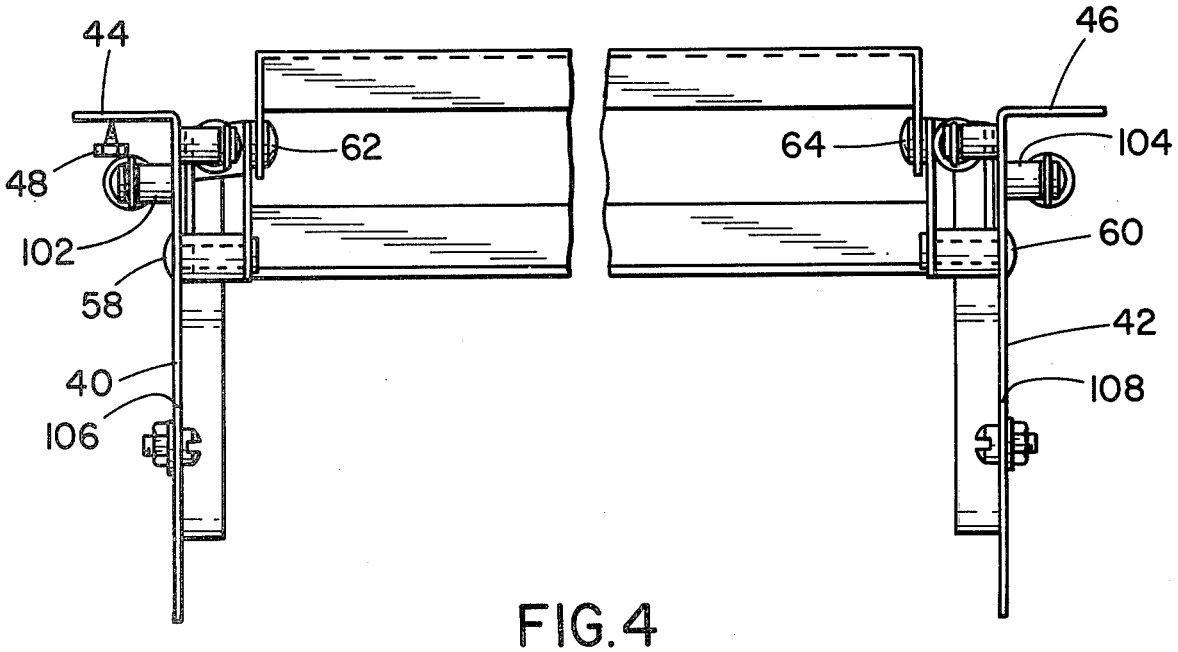
FIG. 4 is an end view of the linkage and mechanism shown in FIG. 2.

Referring to the figures a typical sewing machine cabinet 10 includes a top deck 12 defining a planar top surface 14. An opening 16 in deck 12 is sized to receive a generally rectangular platform 18. A sewing machine head 20 is attached to the platform 18 for movement in unison therewith. The cabinet 10 also includes a hinged member or flap 22 which is hinged to the top deck 12 to cooperatively engage platform 18. Flap 22 swings from a horizontal position when platform 18 is being moved.

The mechanism or device of the present invention includes an improved linkage connecting the platform 18 to the cabinet 10. Referring specifically to FIGS. 2–7 the mechanism of the present invention is illustrated in greater detail. FIG. 2 is a side section view of the platform 18 when it is in the "free arm" position. When in the free arm position, the platform 18 is flush with the top surface 14 and the sewing machine head 20 is positioned so that a needle working surface 24 is above the top surface 14. In this manner, cuffs, pant legs and the like may be fitted over a base portion 26 of the sewing machine head 20.

FIG. 6 illustrates the platform 18 lowered to a second horizontal position wherein the needle working surface 24 of the head 20 is coplanar with the top surface 14 of the cabinet 10. This is the most common position of the sewing machine head 20 for sewing operations and is known as the "flat bed position".

Figure 7:
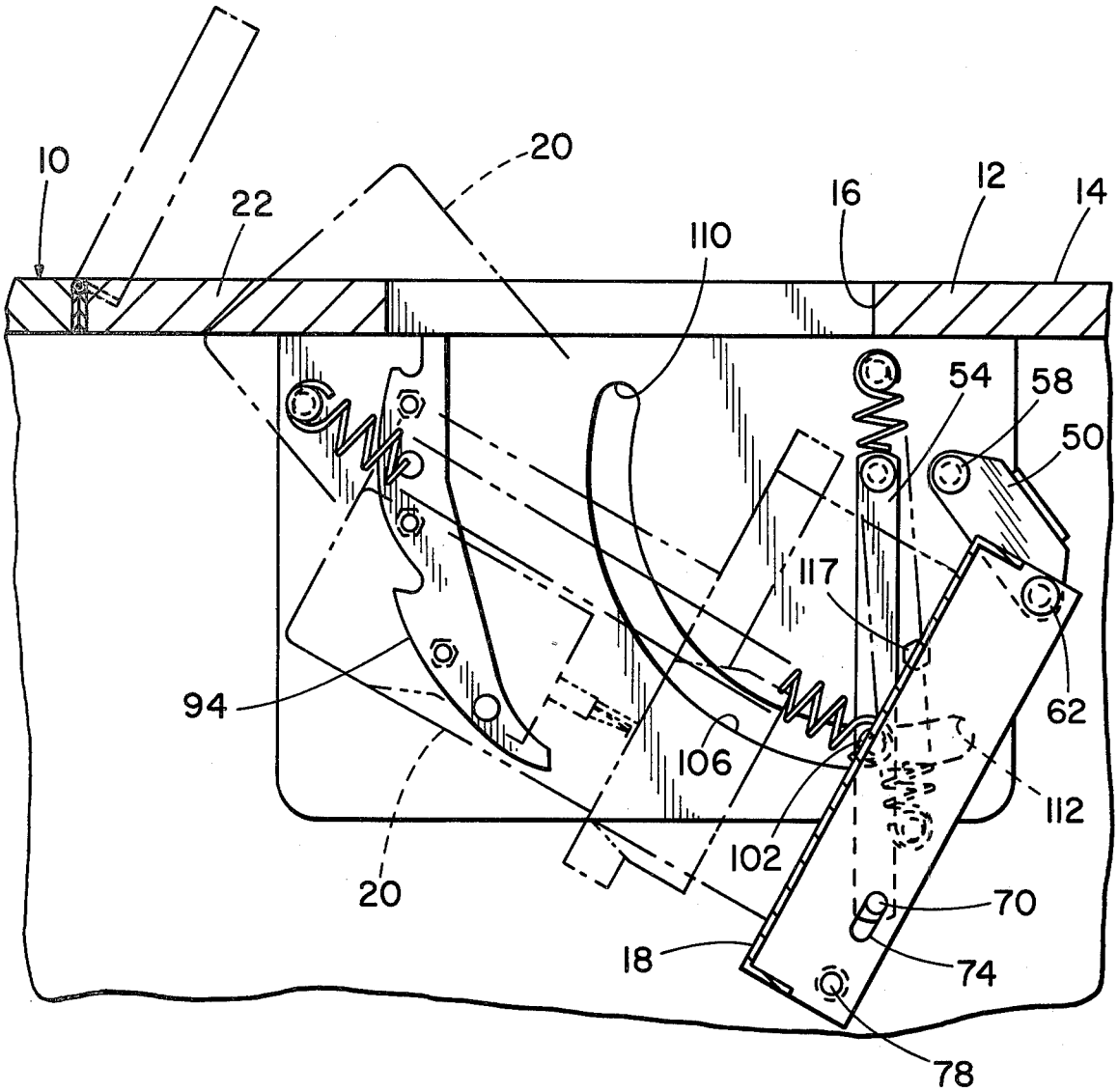
FIG. 7 is a cross sectional side view similar to FIG. 2 wherein the platform has been moved to the storage position.

FIG. 7 illustrates a side section view of platform 18 when lowered to the storage position. When in this position, the head 20 is positioned within the cabinet 10 so that the top surface 14 is generally flat without any obstructions and may thus serve as a table support.

The platform 18 is generally rectangular and includes a planar top surface 28, a back edge 30, a front edge 32, and side edges 34 and 36. The platform 18 also includes a plurality of openings 38 for receipt of fasteners, such as machine bolts, to attach a desired head 20 to the platform 18. The head 20 is thus removable for repair or replacement. The edges 30, 32, 34 and 36 define a circumferential flange with respect to the top surface 28.

The platform 18 is attached by means of pivot arms to a left and right hand cabinet bracket 40 and 42. The brackets 40 and 42 are attached to the cabinet 10 on opposite sides of opening 16 in top surface 14. Brackets 40 and 42 are generally coplanar and parallel to each other as well as being parallel to the side edges 34 and 36 respectively. Brackets 40, 42 are attached to the underside of the top deck 12 by means of attachment flanges 44, 46 respectively which receive fastening means 48. The brackets 40 and 42 are generally transverse to the top deck 12.

The linkage which connects the cabinet bracket 40 with the side edges 34 is substantially a mirror image of the linkage attaching bracket 42 with edge 36. Therefore the following description will reference the linkages associated with both brackets 40, 42 though the description will be given in the singular. Thus the linkage includes a rear pivot arm 50, 52 respectively and a front pivot arm 54, 56. The rear pivot arm 50, 52 connects between a pivot point 58, 60 on the cabinet bracket 40, 42 to a pivot point 62, 64 in side edges 34, 36.

A line between the pivot points 62 and 64 defines a back pivot axis for the platform 18. The back pivot axis is adjacent the back edge 30 of platform 18. A line between the pivot points 58 and 60 defines a cabinet bracket pivot axis which is rearward and downward from the top surface 28 when the platform 18 is in the free arm position.

The front pivot arm 54, 56 is connected at one end to the bracket 40, 42 at pivot point 66, 68. The pivot points 66 and 68 define a pivot axis which is generally in the same horizontal plane as defined by the pivot points 58 and 60. The axis defined by the pivot points 66 and 68 is also positioned substantially in the vertical plane defined by the back edge 30.

The opposite end of the front pivot arm 54, 56 is attached to the side edge 34, 36 near the front edge 32 of platform 18. Specifically, front pivot arm 54, 56 includes a pivot member 70, 72 projecting through a horizontal slot 74, 76 defined in the side edge 34, 36. In this manner the front pivot arm 54, 56 may pivot about the pivot member 70 and 72 as the pivot member 70, 72 slides in the slot 74, 76 thereby permitting adjustment of the relative pivot point and pivot axis through the platform 18.

The front pivot arms 54, 56 also include, intermediate the end pivots, an outwardly projecting follower 102, 104 respectively. Followers 102, 104 engage and cooperate with cam tracks 106, and 108 respectively defined in brackets 40 and 42 respectively. The cam tracks 106 and 108 define an arcuate, substantially constant radius path with respect to the pivot points 66 and 68 respectively. Opposite ends 110 and 112 of the cam track 106 define or limit the movement of the follower 102 and thus limit movement of the front pivot arm 54. The cam track 108 may include similar limiting ends.

To adjust the limit of motion of the pivotal movement of platform 18 it is also possible to include a stop member 114 attached to the bracket 40. Stop member 114 includes a stop edge 116 positioned to engage an edge 118 of front pivot arm 54 and thus limit the rotation of the arm 54 as well as the total assembly. The stop member 114 may be replaced or reversed in position in order to change the position of stop edge 116 and thereby accurately control and limit motion of the front pivot arm 54 and the assembly. Alternatively a bolt and nut (117 in FIG. 2) may be used to limit motion of arm 54.

Positioned forwardly from the slot 74, 76 and substantially in the same horizontal plane are positioner pins 78, 80. Pins 78 and 80 project laterally outward from side edges 34 and 36 respectively. Pin 78 and 80 cooperate respectively with positioner members 82 and 84 respectively attached to the brackets 40 and 42 respectively. Thus the platform 18 is supported by cooperation of the pins 78 and 80 with the positioners 82 and 84 as well as by the pivot arms 50, 52, 54 and 56 previously identified.

The positioners 82 and 84 are substantially identical and, in the embodiment shown include a first or free arm detent 86 and 88 respectively, and a second or flat bed detent 90 and 92 respectively. Additionally, the positioners 82 and 84 include upper pin guide surfaces 94 and 96, respectively, and lower pin guide surfaces 98 and 100, respectively. Surfaces 94, 96 are intermediate detent pairs 86-90 and 88-92 respectively. Surfaces 98, 100 respectively are positioned beneath detents 88, 92 respectively. The pins 78 and 80 cooperate with the detents 86, 90 and 88, 92 respectively as well as the guide surfaces 94, 98, 96 and 100 during movement of the platform 18.

A biasing spring 120, 122 connects between a lug 124, 126 attached substantially at the midpoint of the side edge 34, 36 to a second lug 128, 130 attached to the bracket 40, 42. The center line axis through the lugs 124 and 126, and the center line axis through lugs 128 and 130 are substantially in the same horizontal plane when the platform 18 is positioned in the free arm position as shown in FIG. 2.

A second biasing spring 132, 134 is connected at one end to a lug 136, 138 attached on the outside or side away from platform 18 of the bracket 40, 42. Lug 136, 138 is forward of the front side 32 of the platform 18 when platform 18 is in the free arm position. The opposite end of the spring 132, 134 connects with a lug 140, 142 which projects from the follower 102, 104 through cam track 106, 108. The springs 132, 134 counteract or counterbalance the weight of a sewing machine on the platform 18 as the platform 18 moves toward the storage position.

It is noted that the brackets 40 and 42 are spaced from the side edges 34 and 36 in such a manner as to accommodate springs 120, 122. Consequently, the pivot arms 50, 52, 54 and 56 include various bends or extensions which insure connection between the brackets 40, 42 and side edges 34, 36 as illustrated in FIG. 3. This spacing also accommodates the positioner 82, 84 and transversely extending pins 78, 80.

The radial distance between pivot points 58, 60 and the back axis defined by pivot points 60, 62 is substantially constant or fixed since this radial distance is defined only by the rear pivot arms 50, 52. By contrast, the radial distance between pivot points 58 and 60 and pins 78 and 80 respectively is variable since it depends upon the length and orientation of the platform side edge 34, 36 and rear pivot arms 50, 52. The platform 18 may be tilted from the position of FIG. 2 and moved so as to increase the radial distance by removal of the pins 78 and 80 from the detents 86 and 88 and simultaneous sliding of the pivot members 70 and 72 in the slots 74 and 76.

By properly choosing the position of the detents 86, 88, 90, and 92 with respect to the pivot axis 58 one can maintain the platform 18 in a horizontal position upon movement of pivot arms 50, 52, 54 and 56 to any desired orientation. Thus, it is possible to maintain the platform 18 in a substantially horizontal position in any plane with respect to the surface 14. In the embodiment shown, the detents have been chosen to maintain the platform 18 in a horizontal plane while in the free arm position shown in FIG. 2 and in the flat bed position shown in FIG. 6. In each position the radial distance from pins 78, 80 to points 58, 60 is less than the maximum.

To move the platform 18 from the position in FIG. 2 to the position of FIG. 6, the flap 22 is moved counterclockwise from the platform locking position of FIG. 2 and the head 20 attached to the platform 18 is moved in a clockwise sense accomplished by applying a push force to the head. The head 20 is moved by pushing it as one stands at the front of the sewing machine cabinet. This causes the pins 78 and 80 to ride out of the detents 86 and 88 as the platform 18 pivots on the rear arms 50, 52. Thus the rear pivot arms 50, 52 move in a counterclockwise sense as the platform 18 moves in a clockwise manner. This movement causes the radial distance from pivot points 58, 60 to pins 78, 80 to increase thereby causing the pins 78, 80 to ride out of the detents 86 and 88. Note that the springs 120, 122 normally bias the platform 18 in such a manner as to keep the pins 78 and 80 seated in the detents 86 and 88. Manual tilting of the platform 18 overrides the biasing force of springs 120, 122.

Upon removal of the pins 78 and 80 from the detents 86 and 88, the pins 78 and 80 may ride along surfaces 94, 96 into the next detent 90, 92. The next or lower detent 90, 92 represents the flat bed position of the platform 18 as shown in FIG. 6.

To move the platform 18 from the flat bed position shown in FIG. 6 to the storage position shown in FIG. 7, again the platform 18 is tilted by applying a pulling force to the head when facing the sewing machine. This time the platform is tilted in a counterclockwise direction as viewed in FIG. 6 thereby releasing the pins 78 and 80 from the detents 90 and 92 and permitting the pins to slide along surfaces 98 and 100 to the storage position illustrated in FIG. 7. The sequence may be reversed to move the head 20 from the storage position.

The mechanism described above has been described in relation to the specific application of a sewing machine and associated platform adapted to receive any one of a number of sewing machine heads. The invention is not, however, limited to such an environment. The positioning mechanism is thus applicable to other environments wherein a platform is to be attached to a table cabinet or the like. Also the mechanism has been described as including a platform 18 with linkage on each side of the platform. However, the linkage on only one side of the platform would adequately accomplish the objectives of the invention. Thus, while there has been set forth a preferred embodiment of the invention, it is to be understood that the invention shall be limited only by the following claims and their equivalence.

What is claimed is:

1. A sewing machine head lifter mechanism comprising in combination:

a cabinet having a generally planar working surface with a platform opening through the surface;

a separate platform for mounting a sewing machine head, said platform sized for receipt in the opening and including a back pivot axis and a front support member, said platform being mounted for pivotal movement about the back pivot axis for transport of said platform and attached sewing machine head between a storage position in the cabinet and a use position with respect to the working surface;

at least one bracket member affixed to the cabinet at a side of the platform opening generally transverse to the back pivot axis of the platform;

a pivot linkage pivotally connecting a pivot on the bracket member to the back pivot axis of said platform, said linkage defining a constant radial distance between the back pivot axis and said bracket pivot, and an adjustable radial distance between the support member and said bracket pivot; and a support track affixed to the cabinet, said track including at least one support member engaging means for engaging the support member to thereby maintain the platform in a use position, said support member engaging means fixed at a radial distance from the bracket pivot less than the maximum radial adjustable radial distance.

2. The mechanism of claim 1 including first biasing means for continuously providing a biasing force of said support member toward said bracket pivot.

3. The mechanism of claim 1 including a second linkage member pivotally connected to the cabinet bracket at one end and pivotally connected to the platform at the opposite end, said bracket member including cam track and said second linkage member including a follower cooperative with said cam track to guide the platform in an arcuate path about the bracket pivot axis.

4. The mechanism of claim 3 wherein the follower is intermediate the ends of the second linkage.

5. The mechanism of claim 3 including a lost motion connection between said platform and said second linkage to permit adjustment of the adjustable radial distance to thereby move the support member from the support member engaging means to effect pivoting movement of the platform about the bracket pivot.

6. The mechanism of claim 3 includng second biasing means attached to the second linkage member and to the cabinet for biasing the second linkage member and attached platform toward the use position.

7. The mechanism of claim 3 including limit means for engaging the second linkage and limiting the pivotal movement of the platform about the bracket pivot.

8. The mechanism of claim 3 including adjustable limit means for engaging the second linkage and limiting the pivotal movement of the platform about the bracket pivot.

9. The mechanism of claim 3 including cam track ends cooperative with the follower to limit the arcuate movement of the platform.

10. The mechanism of claim 1 including second biasing means attached to the cabinet and engaging the platform for continuously biasing the platform toward the use position.

11. The mechanism of claim 1 including a plurality of separate support member engaging means arranged generally at an equal radial distance from the bracket pivot.

12. The mechanism of claim 1 including cam track means attached to the cabinet and follower means attached to the platform, said follower means cooperative with said cam track means to define the path said platform pivots about the bracket pivot.

13. The mechanism of claim 12 wherein said limit means is adjustable.

14. The mechanism of claim 12 wherein said limit means comprise a limit plate member affixed to the cabinet for engaging and limiting pivotal movement of the platform.

15. The mechanism of claim 1 including limit means for limiting the pivotal movement of the platform about the bracket pivot.

16. The mechanism of claim 1 wherein said support member engaging means includes a support member guide for cooperatively engaging the support member and guiding said support member and attached platform between use and storage positions.

17. The mechanism of claim 1 including first and second opposed bracket members on opposite sides of the opening cooperative with the platform.

18. The mechanism of claim 1 including first and second opposed cabinet brackets and pivot linkages on opposite sides of the opening cooperative with the platform.

19. A sewing machine head lifter mechanism comprising, in combination:

a cabinet having a generally planar working surface with a platform opening through the surface;

a separate platform for mounting a sewing machine head, said platform having a back side, side edges and sized for receipt in the opening and also including a back pivot axis and front support members projecting laterally in opposite directions from the platform, said platform being mounted to pivot about the back axis between a storage position and at least one use position with respect to the working surface;

first and second cabinet bracket members positioned respectively on opposite sides of the platform laterally from the side edges of the platform and in a plane transverse to the back axis;

first and second rear pivot arms pivotally connected between a pivot point on the first and second bracket members respectively and the back axis of the platform;

first and second support member engaging means affixed to the cabinet and positioned respectively on opposite sides of the platform laterally from the side edges, each engaging means adapted to receive a support member in at least one support position when the support member is positioned at a predetermined radial distance the pivot point and the rear pivot arms are in a prescribed orientation, the rear pivot arms maintaining a constant radial distance between the back axis and the bracket member pivot points, said support members having a variable and adjustable radial distance between the front support members and the bracket member pivot points whereby said platform is adjusted in position relative to the working surface by altering the orientation of the rear pivot arms about the pivot point to simultaneously vary the radial distance of the front support members from the predetermined distance and cause disengagement thereof from the engaging means.

20. The mechanism of claim 19 wherein said support member engaging means includes a plurality of support positions at discrete orientations of the rear pivot arms and discrete radial distances between the pivot points and support members.

21. The mechanism of claim 19 including means for biasing the platform toward the support member engaging means whenever said support member is received by the support member engaging means.

22. The mechanism of claim 19 wherein said support member engaging means includes a position with the platform coplanar with the working surface and a distinct position with the platform below the plane of the working surface.

23. The mechanism of claim 19 including first and second front pivot arms pivotally connected at one end respectively to opposite side edges the platform and at the opposite end to the cabinet, said front pivot arms movable in planes transverse to the back axis and each including means for adjusting at least one pivot connection.

24. The mechanism of claim 23 wherein the pivot connection of the front pivot arms to the platform comprises a slot in the platform for receipt of a pivot member attached to the front pivot arm to provide the means for adjusting the pivot connection.

25. The mechanism of claim 23 including a cam track attached to the cabinet and a follower attached to a front pivot arm cooperative with the cam track.

26. The mechanism of claim 19 including means for biasing the platform toward a use position.

27. A sewing machine head lifter mechanism comprising, in combination:

cabinet having a generally planar working surface with a platform opening through the surface;

a separate platform for mounting a sewing machine head, said platform having a back side, side edges and sized for receipt in the opening and also including a back pivot axis, and a front support member projecting laterally from a side edge, said platform being mounted to pivot about the back axis between a storage position, an intermediate horizontal position and a raised horizontal position;

a cabinet bracket member positioned at a side of the platform opening adjacent a side edge of the platform;

a rear pivot arm pivotally connected respectively between a side edge of the platform at the back axis and the cabinet bracket member;

a front pivot arm connected at one end between the side edge of the platform intermediate the back axis and the support member and at the other end to the cabinet bracket member, said front pivot arm including at least one adjustable pivot connection;

a support member positioner attached to the cabinet in opposed relation with the platform support member, said positioner including an intermediate detent position and a raised detent position; and means for biasing the front support member toward the detent positions whereby the platform is adjustable by pivoting the platform on the pivot arms to engage and release the support member from the detent positions against the force of the means for biasing.

28. The mechanism of claim 27 including a cam track attached to the cabinet and a cam track follower attached to the front pivot arm for cooperation with the track, said track and follower restricting the pivotal movement of the pivot arms.

29. The mechanism of claim 27 including additional means for biasing connected between the cabinet and the front pivot arm to counteract movement of the platform to the storage position.

30. The mechanism of claim 27 including limit means for limiting the pivoting movement of the pivot arms.

31. The mechanism of claim 27 including a second cooperative set of components including a front pivot arm, rear pivot arm, means for biasing, support member, cabinet bracket member and positioner all arranged on the opposite of the platform as a mirror image of the first set of said components.

32. A machine platform lifting mechanism comprising, in combination:

a cabinet having a generally planar working surface with a platform opening through the surface;

a separate platform for mounting a sewing machine, head said platform having a back side, side edges and sized for receipt in the opening and also including a back pivot axis, and a front support member projecting laterally from a side edge, said platform being mounted to pivot about the back axis between a storage position, a use position;

a cabinet bracket member positioned at a side of the platform opening adjacent a side edge of the platform;

a rear pivot arm pivotally connected at one end to a side edge of the platform at the back axis and at the other end to the cabinet bracket member;

a front pivot arm connected at one end between the side edge of the platform intermediate the back axis and the support members and at the other end to the cabinet bracket member, said front pivot arm including at least one adjustable pivot point connection;

a support member positioner attached to the cabinet in opposed relation with the platform support member, said positioner including a raised detent position; and means for biasing the front support member toward the detent position whereby the platform is adjustable by pivoting the platform on the pivot arms to engage and release the support member from the detent position against the force of the means for biasing.

33. A sewing machine head lifter mechanism comprising in combination:

a cabinet having a generally planar working surface with a platform opening through the surface;

a separate platform for mounting a sewing machine head, said platform sized for receipt in the opening and including a back pivot axis and a front support member, said platform being mounted for pivotal movement about the back pivot axis for transport of said platform and attached sewing machine head between a storage position in the cabinet and a use position with respect to the working surface;

at least one bracket member affixed to the cabinet at a side of the platform opening generally transverse to the back pivot axis of the platform;

a pivot linkage pivotally connecting a pivot on the bracket member to the back pivot axis of said platform, said linkage defining a constant radial distance between the back pivot axis and said bracket pivot, and an adjustable radial distance between the support member and said bracket pivot;

a support track affixed to the cabinet, said track including at least one support member engaging means for engaging the support member to thereby maintain the platform in a use position, said support member engaging means fixed at a radial distance from the bracket pivot; and a second linkage member pivotally connected to the cabinet bracket at one end and pivotally connected to the platform at the opposite end, said bracket member including a cam track and said second linkage member including a follower cooperative with said cam track to guide the platform in an arcuate path about the bracket pivot axis.

* * * * *